United States Patent [19]

Laity

[11] 4,039,301

[45] Aug. 2, 1977

[54] GASOLINE COMPOSITION

[75] Inventor: John L. Laity, Edwardsville, Ill.

[73] Assignee: Shell Oil Company, Houston, Tex.

[21] Appl. No.: 565,299

[22] Filed: Apr. 4, 1975

Related U.S. Application Data

[63] Continuation-in-part of Ser. No. 495,735, Aug. 8, 1974, abandoned.

[51] Int. Cl.[2] ..... C10L 1/20

[52] U.S. Cl. ..... 44/62; 44/70

[58] Field of Search ..... 44/62, 79, 70

[56] References Cited

U.S. PATENT DOCUMENTS

| | | | |
|---|---|---|---|
| 2,680,717 | 6/1954 | Little, Jr. | 44/62 |
| 3,207,730 | 9/1965 | Guenthner | 44/79 |
| 3,784,362 | 1/1974 | Siegart et al. | 44/62 |
| 3,793,266 | 2/1974 | Bialy et al. | 44/62 |
| 3,847,887 | 11/1974 | Siegart et al. | 44/62 |

*Primary Examiner*—Daniel E. Wyman
*Assistant Examiner*—Mrs. Y. Harris-Smith
*Attorney, Agent, or Firm*—Henry C. Geller; Albert A. Jecminek; Ronald R. Reper

[57] ABSTRACT

Novel gasoline compositions comprising gasoline and dissolved or dispersed therein small quantities of from about 0.5 to about 100 parts by weight of a driveability-enhancing fluorine-containing polymer per million parts of gasoline will, after carburetion in a multicylinder automobile engine, plate out a fluoropolymeric deposit on the interior surfaces of the intake manifold of the engine thereby establishing on the manifold metal surface a coating of low wettability by any hydrocarbon gasoline component, either aliphatic or aromatic, and significantly improving the driveability performance of the engine. The driveability-enhancing fluorine-containing polymers useful in the gasoline compositions of the invention are characterized in that they must (1) have a critical surface tension of <17 dynes/centimeter at 25° C, (2) have a high contact angle of at least 40° to toluene at 22° C, (3) contain fluorine in the range of from about 20 to about 65% by weight and (4) have a minimum solubility in gasoline of at least about 5 parts by weight per million. Illustrative examples of fluorine-containing polymers which have these properties and are useful in the compositions include homopolymers of esters of fluorine-containing alcohol and monoethylenically unsaturated lower monocarboxylic or corresponding thio acid or copolymers of said fluorine-containing esters and a monoethylenically unsaturated non-fluorinated monomer selected from the group consisting of acrylic acid derivatives, alpha-olefins and other vinyl compounds. Also a method is provided for improving the driveability of an automobile by operating its internal combustion engine on the above novel gasoline compositions.

7 Claims, 1 Drawing Figure

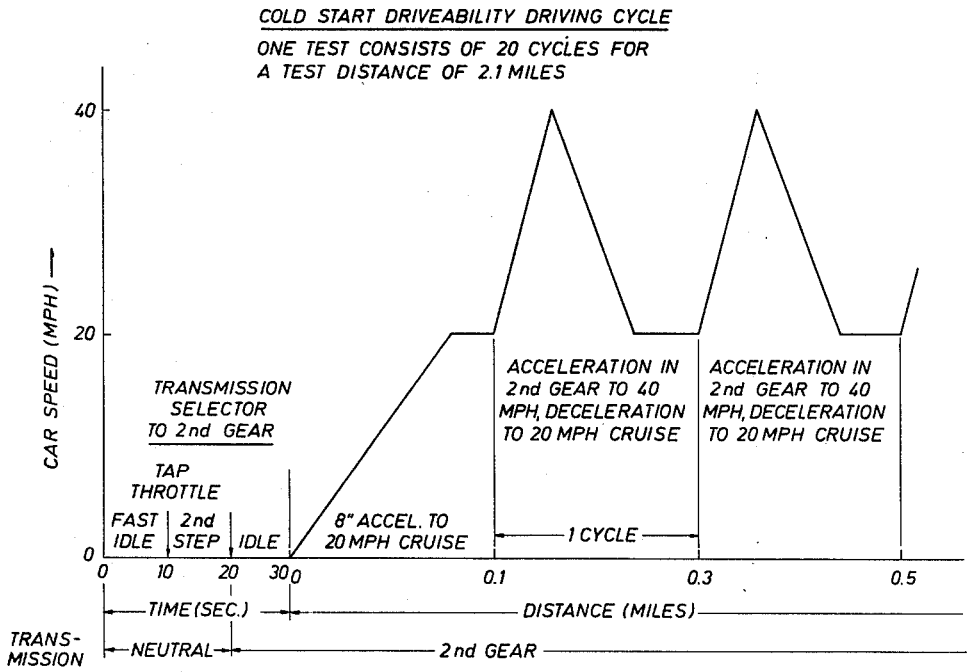

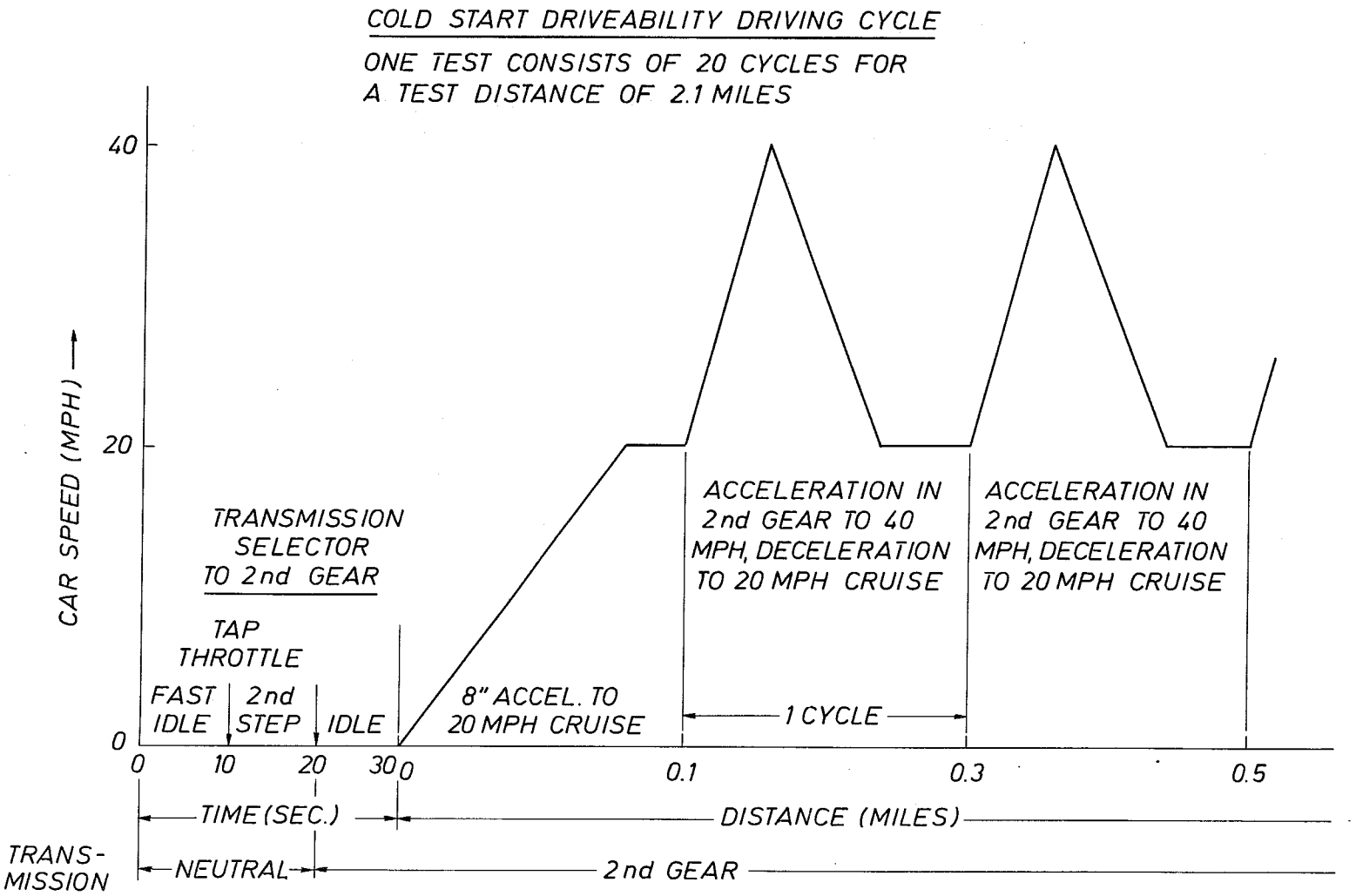
COLD START DRIVEABILITY DRIVING CYCLE
ONE TEST CONSISTS OF 20 CYCLES FOR A TEST DISTANCE OF 2.1 MILES
CAR SPEED (MPH)
40
20
0
TRANSMISSION SELECTOR TO 2nd GEAR
TAP THROTTLE
FAST IDLE
2nd STEP
IDLE
8" ACCEL. TO 20 MPH CRUISE
ACCELERATION IN 2nd GEAR TO 40 MPH, DECELERATION TO 20 MPH CRUISE
ACCELERATION IN 2nd GEAR TO 40 MPH, DECELERATION TO 20 MPH CRUISE
1 CYCLE
0
10
20
30
0
0.1
0.3
0.5
DISTANCE (MILES)
TIME (SEC.)
NEUTRAL
2nd GEAR
TRANS-MISSION

GASOLINE COMPOSITION

CROSS-REFERENCE TO RELATED APPLICATIONS

This is a continuation-in-part of applicant's copending application Ser. No. 495,735, filed Aug. 8, 1974, now abandoned.

BACKGROUND OF THE INVENTION

As is known, inherent in the conventional carbureted multicylinder automobile engine are various factors which influence the driveability of the automobile. One such principal factor is the distribution of the air/fuel mixture to the various cylinders through the intake manifold.

In the past any problems arising from the distribution of the fuel in the induction system of the automobile engine has been mitigated or solved by operating the engine on a richer air/fuel mixture, one having a greater than stoichiometric mixture for complete combustion. This mixture was generally chosen to obtain maximum power with maximum fuel economy.

In order to comply with legislative controls for automotive emission, automotive manufacturers now design automobile engines to operate on leaner air/fuel ratios approaching the stoichiometric mixture, that is, one containing the chemically correct proportions of fuel and air for complete combustion. Although operating with these leaner ratios helps control hydrocarbon and carbon monoxide emissions, the cylinder-to-cylinder distribution problem is accentuated and it is no longer possible to solve the distribution problem by using the richer air/fuel mixtures. Though this lean carburetion is a principal factor, it is not the only cause for poor driveability.

Additionally, the engine warm-up period immediately subsequent to cold start is very difficult to control and in the past choke control was longer in order to improve driveability during the warm-up period. However, in order to cut back on exhaust emissions, longer choke periods are no longer permissible and the resulting leaner air/fuel mixture used during the warm-up cycle has also accentuated the driveability problem.

The partially-oxidized metal layers comprising the carburetor and intake manifold interior surfaces have high critical surface tension and wettability and are completely wet by any hydrocarbon gasoline component, either aliphatic or aromatic. The mixture of gasoline and air that leaves the carburetor and passes to the various cylinders through the intake manifold thereby tends to deposit some of the higher boiling fractions particularly rich in aromatics in the form of a liquid film on these surfaces particularly on the walls of the intake manifold. For the best distribution of the fuel in the induction system, the gasoline should be present as a vapor in the air/fuel mixture; therefore, this wetting of this surface contributes to less satisfactory distribution and poor driveability.

It has been disclosed by A. A. Zimmerman et. al, "Improved Fuel Distribution — A New Role for Gasoline Additives," Paper 720082 presented at Automotive Engineering Congress, Detroit, January, 1972 (SAE Transactions, Sec. I, Vol. 81 (1972), pp. 316–324) that low energy surfaces can be produced in the intake manifold by inclusion of additives in the gasoline at concentrations of less than 100 ppm which deposit out gradually, or by precoating of the manifold surfaces. Zimmerman et al recommend materials with critical surface tensions less than about 22 dynes/cm. The value of this physical property is determined from a plot of surface tension of a homologous family of alkanes (hexane, heptane, octane, decane) against the cosine of their contact angles, $\theta$, on a surface; all alkanes having surface tensions equal to or lower than the value of the critical surface tension of the particular surface completely wet the surface. Thus the teaching of Zimmerman et al is relevant for alkanes or the aliphatic portion of gasoline. All contemporary gasolines contain an aromatic fraction. At the intake manifold a great majority of the liquid volume of gasoline, mainly the light alkanes, has been flashed off leaving the heavier aromatics as the major constituent of the liquid drops on the intake manifold surface. Thus, it has now been found that there is an increased criticality of aromatics and the wettability thereof at the intake manifold surface in contrast to the aromatics in gasoline in the fuel tank of the automobile or in the carburetor. It has now been discovered that the essence of supplying an advantageous driveability-enhancing additive or coating, especailly a fluorine-containing polymer, for the intake manifold surface is to select one that has a high contact angle with toluene, a representative aromatic liquid, thereby obtaining intake manifold surfaces that repel aromatics, i.e., they have low wettability by aromatics. While it appears that a high contact angle or low critical surface tension with alkanes is of some significance in attaining good driveability characteristics with gasolines, it is now apparent that the real critical factor in obtaining enhanced driveability is this low wettability of the manifold surface by aromatics, a factor which heretofore has neither been acknowledged or even recognized in the prior art, e.g., see the cited paper by Zimmerman et al.

While Zimmerman et al point out the disadvantges of using fluorocarbon additives to coat the intake manifold surfaces in terms of cost and possibility of release of toxic and corrosive hydrogen fluoride in the exhaust, they indicate that coating the intake manifold surface with a fluorine-containing polymer such as Teflon$^R$ tetrafluoroethylene polymer, which has a critical surface tension of 18 dynes/cm and repels alkanes having surface tensions greater than this value, produces partial wetting of the surface by gasoline and improves the distribution and the driveability. However, in order to achieve these effects, the intake manifold surface must be mechanically coated with the Teflon$^R$ polymer; this means the intake manifold surface must be precoated with the Teflon$^R$ polymer, for example, during manufacture of the engine, or, for cars already on the road, it would be necessary to rebuild the engine. In U.S. Pat. No. 3,791,066, issued February 12, 1974, it is proposed to avoid the use of polymers by applying low-molecular weight fluorine-containing materials which are highly soluble in gasoline. These materials are fluorinated aliphatic hydrocarbon, fluorinated aliphatic hydrocarbyl amine, or fluorinated aliphatic hydrocarbyl amine salt, that is, hydrocarbyl or amino-substituted hydrocarbyl fluorides.

SUMMARY OF THE INVENTION

It has now been discovered that certain fluorine-containing polymers not considered in general to be hydrocarbon-soluble materials (see, for example, U.S. Pat. No. 2,803,615)--but selected and delineated by four critical properties, viz., (1) a specific minimum solubility in gasoline, (2) a high contact angle to toluene, (3) a specific upper limit of critical surface tension, and (4) a particular range of fluorine content--need not be applied to the intake manifold metal surfaces mechanically; instead they can be distributed in situ by dissolution or dispersion in gasoline in sufficient concentrations so as to effectively plate out, i.e., deposit on, and coat the intake manifold surfaces advantageously resulting in an intake manifold coating having high repellancy for aromatics as well as aliphatics and an engine fuel system yielding enhanced driveability.

Accordingly, the instant invention includes within its scope novel gasoline compositions comprising gasoline and dissolved or dispersed therein small quantities of from about 0.5 to about 100 parts by weight per million parts of gasoline of a fluorine-containing polymer possessing (1) a critical surface tension of less than 17 dynes/centimeter at 25° C, (2) a high contact angle of at least 40° to toluene at 22° C, (3) a minimum solubility in gasoline of at least about 5 parts by weight per million, and (4) a fluorine content in the range of from about 20 to about 65% by weight of fluorine, which will, after carburetion in a multicylinder automobile engine, plate out a fluoropolymeric deposit on the interior surfaces of the intake manifold of the engine thereby establishing on the manifold metal surface a coating of low wettability by any hydrocarbon gasoline component, either aliphatic or aromatic. The use of the above gasoline composition significantly improves the driveability performance of a multicylinder automobile engine operated with said gasoline composition.

Furthermore, the fluorine-containing polymeric materials having the hereinabove specific properties and used in the gasoline of the invention are of high thermal stability so that, after combustion of such a gasoline composition in the automobile engine, no toxic and corrosive hydrogen fluoride is released in the exhaust at any level equal to or greater than the hydrogen fluoride level commonly observed in atmospheric air samples.

It is also an advantage of the instant invention that a gasoline containing dissolved or dispersed therein the above specifically characterized fluoropolymeric material will deposit on and coat the intake manifold surfaces even in the presence of effective gasoline detergent and/or dispersant additives. It is, indeed, surprising that these additives do not interfere appreciably with the deposition of the polymeric material.

It is an additional object of the invention to provide a method for improving the driveability of an automobile by operating its internal combustion engine on the above-defined novel gasoline composition.

DESCRIPTION OF THE PREFERRED EMBODIMENTS

The base component of the novel gasoline compositions of the invention is the motor fuel, gasoline. As is well-known in the art, gasoline can be defined as a mixture of hydrocarbons of various boiling points and having a boiling range determined according to ASTM Method D-86 between about 20° and 230° C. Gasoline in general contains from about 0 to about 30% by volume of olefins, from about 5 to about 55%, preferably from about 10 to about 45%, by volume of aromatics, and the remainder, saturates.

The driveability-enhancing fluorine-containing polymers useful in the compositions of the invention possess four specific properties. One property that the polymeric material must exhibit is a high contact angle (←) of at least 40° To toluene at 22° C. This property insures in the coating laid down on the intake manifold surface the requisite repellency to aromatic components in the gasoline. Polymers with contact angles to toluene at 22° C below 40°, and particularly well below, become more and more wettable by aromatics in proportion to the decrease in this value. No upper limit need be stipulated as the only criticality resides in the lower limit; the higher the contact angle to toluene, the lower is the wettability by aromatics on up to the theoretical high of ←=180°. A second property that the polymeric material must exhibit is a critical surface tension ($\alpha_c$) of value less than 17 dynes/centimeter at 25° C; no lower limit need be stipulated as the only criticality resides in the upper limit. This property maintains that the ultimate coating in the intake manifold will have high repellency to or low wettability by aliphatic components in gasoline. The third property that the polymeric material must possess is a minimum solubility in gasoline of at least about 5 parts by weight per million. It is to be understood that the minimum solubility is for ambient temperature with reference to gasoline in blending tanks, storage tanks or in the fuel tank and carburetor of an automobile, that is, the temperature gasoline exhibits after its production in a refinery through transport, storage, sale and carburetion. The solubility as used herein is defined to include a stable dispersion in that the value of the solubility is determined by the lowest concentration at which no polymeric material precipitates from the gasoline upon standing for several days. No maximum solubility need be stipulated because the polymeric material can be any degree of solubility greater than the minimum and be used in the gasoline within the range of the desired concentration limits. The fourth property that the polymeric material must have is a fluorine-content in the range of from about 20 to about 65% by weight of fluorine. The lower limit aids in insuring along with the other properties that the ultimate coating has sufficient repellency to gasoline. The upper limit is a practical one of balancing achievement of only little more repellency benefit at a very high cost and lower solubility.

While not limiting the invention thereby, illustrative examples of fluorine-containing polymers which possess the above-mentioned properties and are useful driveability-enhancing additives for the gasoline compositions of the invention include homopolymers of esters of fluorine-containing alcohol and monoethylenically unsaturated lower monocarboxylic or corresponding thio acid or copolymers of said fluorine-containing esters and a monoethylenically unsaturated non-fluorinated monomer selected from the group consisting of acrylic acid species, alpha-olefins, and other vinyl compounds. The driveability-enchancing fluorine-containing polymer may also be a mixture of polymers, said mixture possessing the hereinabove-defined four specific properties of the polymeric material.

More particularly, said monoethylenically unsaturated lower monocarboxylic or corresponding thio acids include acrylic, methacrylic, crotonic, isocrotonic, vinylacetic, angelic, tiglic, thioacrylic and thiomethacrylic acids; especially useful are acrylic, thioacrylic, methacrylic and thiomethacrylic acids. The fluorine-containing alcohols which are useful for conversion of these acids to the desired fluorine-containing esters (the monomeric material convertible to the required polymers) are any alcohol containing fluorine in sufficient quantity that the ultimate polymer derived therefrom contains at least about 20%, as well as not more than about 65%, by weight of fluorine. More particularly, fluoroalkanols such as 1H,1H-dihydroperfluoroalkanols, 1H,1H,2H,2H-tetrahydroperfluoroalkanols and fluoroalkanols containing functional groups such as perfluoroalkanesulfonamido alkanols are preferred.

An especially useful group of fluorine-containing esters convertible to the homopolymers and copolymers used in the compositions of the invention are the acrylate and thioacrylate esters and methacrylate and thiomethacrylate esters of perfluoroalkanols, perfluoroalkane alkanols and perfluoroalkanesulfonamido alkanols having from 4 to 14 carbon atoms in the perfluoroalkane moiety and from 1 to 11 carbon atoms in the alkanol moiety. From these an especially useful polymer is derived having the recurring unit

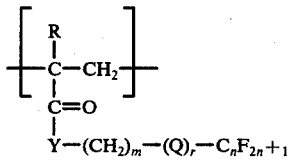

where R is H or $CH_3$, Y is oxygen or sulfur, *m* is 1 to 11, — Q — is

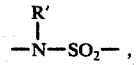

R′ is hydrogen or alkyl of 1 to 6 carbon atoms, *r* is 0 or 1, and *n* is an integer from 4 through 14.

The fluorine-containing polymers useful in the compositions of the invention in addition to the above-mentioned homopolymers, may be copolymers of the above-mentioned fluorine-containing ester monomers and a monoethylenically unsaturated nonfluorinated monomer selected from the group consisting of acrylic acid species, alpha-olefins, and other vinyl compounds. Representative illustrations of acrylic acid species include esters and amides of acrylic and methacrylic acid, such as alkyl acrylate, alkyl methacrylate, hydroxyalkyl acrylate, hydroxyalkyl methacrylate, N-methylolacrylamide, N-methylolmethacrylamide, and the like. The alkyl groups mentioned above preferably have from 2 to 18 carbon atoms. Representative illustrations of alpha-olefins include styrene, alkyl styrenes, and the like, the alpha-olefins preferably having from 8 to 12 carbon atoms. It is to be understood that the copolymer should contain the same range of fluorine content as do the above-mentioned homopolymers, that is, from about 20 to about 65% by weight of fluorine.

Also the fluorine-containing polymers may additionally contain nitrogen and may be derived from acylating amino-containing polymer with fluorine-containing carboxylic acids (or their esters) to give a polyamide or a polyimide fluorine-containing polymer such a perfluoroamide-aziridine polymer or a perfluoroalkanoyl-substituted poly(ethyleneimine). Useful acids are $R_fCO_2H$ where $R_f$ is a perfluoroalkyl group of 3 through 13 carbon atoms.

The fluorine-containing polymers can be prepared by methods known to the art; see, for example, U.S. Pat. Nos. 2,803,615, 3,282,905, 3,256,230, 3,356,628, 3,248,260, 3,171,861 and 2,642,416.

In general, many of the fluorine-containing polymers used in the novel gasoline compositions of this invention are described in the art as insoluble in hydrocarbons. It has been found unexpectedly that, in the small quantities in which these polymers are required in the gasoline compositions of the invention, most of the polymers having the requisite minimum solubility in gasoline of 5 ppm by weight or greater are hydrocarbon soluble to the extent necessary to achieve the desired gasoline compositions. The desired composition is from about 0.5 to about 100 parts by weight of the fluorine-containing polymer per million parts of gasoline, and preferably from about 5 to about 50 parts by weight per million polymer in gasoline. However, to the extent that the polymers near to or at the minimum 5 ppm level of solubility can only with difficulty be dissolved directly in gasoline to obtain the desired compositions for purposes of this invention, the novel gasoline compositions can be produced by utilizing a solvent material in which the fluorine-containing polymer is soluble, which material can be referred to as a co-solvent. the fluoropolymer is dissolved in substantial quantities of the co-solvent to produce solutions in the range of about 0.1 to about 2% by weight. This concentrated solution of the polymer in the co-solvent is then added to the gasoline while mixing efficiently. The result of this operation is that the fluoropolymer remains disseminated in the gasoline i.e., either dissolved or dispersed in appreciable quantities, so that a solution or stable dispersion of fluoropolymers within the desired composition range of about 0.5 to about 100 parts by weight of the fluoropolymer per million parts of gasoline is maintained in the gasoline. The co-solvent functions to disperse and/or dissolve the fluoropolymer and prevent its agglomeration at the time of addition to the gasoline. Furthermore, the co-solvent is present in sufficiently small quantities so that it does not appreciably change the physical properties of the gasoline. The novel gasoline compositions containing fluoropolymer upon vaporization in the carburetor of the automobile engine produces the requisite plating out of the polymer on the surface of the intake manifold resulting in the hydrocarbon-insoluble coating of low wettability by any hydrocarbon gasoline component, either aliphatic or aromatic, at the desired place in the engine system. Useful co-solvent for the above process includes any solvent in which the fluoropolymers are soluble. Especially useful are low-boiling halogenated or oxygenated solvents; representative of such solvents are halogenated compounds such as 1,3-di(trifluoromethyl)benzene, 1,1,1-trichloroethane, the liquid Freon compounds, e.g., 1,1,2-trichlorotrifluoroethane, and the like, and the common oxygenated solvents such as acetone, ethyl acetate, 2-butanone, methyl isobutyl ketone, and the like. Accordingly, a useful additive concentrate for a gasoline composition comprises a low-boiling halogenated or oxygenated solvent and a fluorine-containing polymer having the hereinabove-defined four specific properties, said polymer being present in an amount of from about 0.1 to about 2% by weight based on said solvent.

For the purposes of this invention, the term "plating out" is used to mean that the fluorine-containing polymer is adsorbed. It is interesting to note that it has been found that the gasoline composition of the invention, that is, gasoline containing the fluorine-containing polymers, can be stored in metal containers for months and there is no plating out, i.e., no adsorption of the polymer on metal. The highly surprising effect rendered by the novel gasoline compositions of the invention is that the fluorine-containing polymer plates out or is deposited at the desired specific place, at the metal inner surfaces of the intake manifold.

An added advantage of the use of these fluoropolymers in the gasoline compositions of the invention is that it has been found that these polymers do not cause any engine corrosion problems. Even more important than engine corrosion is concern for toxic emissions from byproducts of combustion of gasoline containing fluoropolymers. The major potential pollutant of concern upon combustion of such polymers is hydrogen fluoride. Hydrogen fluoride is commonly observed in aid samples at concentrations between 0.8 and 18 parts by weight per billion. Concentrations as high as 17 parts by weight per billion have been observed in residential areas. Emission tests were conducted with novel gasoline compositions of the invention at about 10 ppm concentration of fluoropolymer and these tests indicate that less than about 0.1% of fluoropolymers in the gasoline upon combustion is converted to exhaust hydrogen fluoride at a steady cruise engine condition. Based upon the lower limit of detectability of fluoride, which as 8 micrograms of fluoride in the sampling system in most of the tests, the concentration of hydrogen fluoride in exhaust can be approximated as less than about 0.4 parts by weight per billion. Thus, the hydrogen fluoride in raw exhaust from these gasoline compositions is less than the hydrogen fluoride level commonly observed in atmospheric air samples. It is interesting to note that, at temperatures achieved under operating conditions in combustion chamber of an automobile engine, polymers, such as poly(vinyl fluoride), poly(vinylidene fluoride) and the like, tend to decompose yielding hydrogen fluoride. Furthermore, any excess of the fluoropolymers of the invention which is not deposited oradsorbed on the intake manifold surface of the engine survives the temperature conditions of the automotive engine combustion chamber. Said excess goes to the walls of the combustion chamber, to the ring-swept area of the cylinder and is swept into the crankcase, much in the manner of other excess portions of gasoline additives which may not be completely combusted.

Another unexpected result from the use of the novel gasoline compositions of the invention is one which is especially advantageous in light of projected lower growth rate of available hydrocarbon supplies as compared with growth in demand for hydrocarbons. In order to improve the driveability of an engine heretofore, more volatile hydrocarbon components were blended with the gasoline. By improving the driveability using the gasoline compositions of the invention rather than by hydrocarbon blending, light hydrocarbons in an amount of up to about 2% by volume of gasoline can be more effectively utilized elsewhere. In a market as large as the gasoline market, such diversion is a considerable gallonage.

The gasoline compositions of the invention may contain additionally other additives which are well know to the art. Alkyl lead antiknock agents may be present along with customarily employed scavenging agents in concentrations producing either "conventionally leaded" or low-lead gasoline as is known in the art. Lead compounds may also be absent to the extent required for maintaining the gasoline compositions of the invention as unleaded gasoline. Organo-metallic antiknock agents other than lead compounds may be employed also. Other additives conventionally employed in gasolines may be used in practicing the present invention. These include corrosion or rust inhibitors, antioxidants, solvent oils, metal deactivators, anti-icing agents, dyes and the like. There may also be included nitrogen-containing gasoline detergent/dispersant additives such as those described in U.S. Pat. Nos. 3,438,757, 3,574,576, and 3,753,670. One would expect that these detergent-type additives would interfere with the deposition of the driveability-enhancing fluorine-containing polymers on the surface of the intake manifold. Unexpectedly, it has been found that the detergent-type additives do not interfere with the deposition of a polymer to an appreciable extent and, to the small extent that they do interfere, the effect may be compensated for by using at least about 5 parts (by weight) per million of the fluoropolymer in gasoline as a minimum, rather than about 0.5, when these detergent/dispersant additives are present.

In the hereinabove examples, reference is made to driveability procedures. Various elements of driveability are measured with ratings given in the form of demerits. The demerits are then weighed according to a weighing factor. Some of the elements included in rating driveability are idle roughness, hesitation, stumble, surge, stalling at start, driving stalling, backfiring, and starting time. Excluded from these elements are engine roughness and noise due to engine knock caused by too low octane fuel. In rating driveability, each given malfunction based upon the demerits and weighing factors is rated as "trace, moderate and heavy". These ratings refer to malfunctions just discernable to a test driver, probably noticeable to an average driver or judged to be obvious to any driver. To evaluate the benefits of the novel compositions of this invention, driveability tests were conducted by operation of a 1971 automobile in a constant-temperature-chassis-dynamometer room using a modified form of a driveability test cycle developed by the Coordinating Research Council (CRC). Significant references to such test procedures include R. J. Wahrenbrock and J. B. Duckworth, "Driveability Testing on a Chassis Dynamometer" SAE Transactions (1972), p. 196, paper 720933, and "Driveability Evaluation in Cool Weather," CRC Report No. 439, Dec. 1970. An alternative driveability test procedure for evaluating gasoline additive performance involves operation with a laboratory V-8 engine connected to an engine dynamometer and includes a two-hour cold soak, cold start, and 20 cold driveaway accelerations from idle-drive to engine conditions that would be present at about 10–15 miles per hour. This procedure simulates starting an automobile's engine in a parking lot, followed by a series of short (50 feet) heavy accelerations similar to moving up a steep hill while in line at a stop sign.

EXAMPLE 1

Each fluorine-containing polymer in Table 1 below was coated on a piece of aluminum in order to measure the critical surface tension $\gamma_c$, by measuring the contact angles, as is known in the art. In this method the equilibrium contact angel $\theta$, of a sessile drop of any pure liquid, for example, a homologous family of n-alkanes (n-hexane, n-octane, n-decane and n-dodecane), on the horizontal surface of the fluoropolymer is measured along with the surface tension at the interface of the liquid and vapor phases ($\gamma_{LV}$) of the drop. A plot of cos $\gamma$ against the surface tension ($\gamma_{LV}$) of the liquid is made for n-hexane, n-octane, n-octane, n-decane and n-dodecane, the homologous family of n-alkanes, for each polymer. The graphical intercept with the straight line cos $\theta=1$ is defined as the critical surface tension of wetting, $\gamma_c$. In this manner contact angles and surface tensions were measured at 25° C and the critical surface tensions given in Table 1 were determined therefrom. Since a liquid will wet any surface whose critical surface tension is greater than the surface tension of the liquid, the critical surface tension value defines the wettability of the surface. Also given in Table 1 for each polymer are its fluorine content and its solubility in gasoline.

Table 1

| Polymer | Fluorine Content % by wt, F | Critical Surface Tension, $\gamma_c$ at 25° C dynes/cm | Solubility of Polymer in Gasoline ppm (by wt) at 22° C | at 1° C |
|---|---|---|---|---|
| A | 64 | 14 | 50 | 5 |
| B | 30 | 15 | 500 | 100 |
| C | 58 | 12 | 50 | 5 |
| D | 37 | 16 | 2,000 | 100 |
| E | 47 | 15 | 200 | 10 |

Polymer A is a poly(1H,1H-pentadecafluorooctyl methacrylate). Polymer B is a mixture comprising about 40% by weight of a copolymer of styrene and butyl methacrylate and about 60% by weight of a perfluoroisopropylperfluoroalkylmercaptoalcohol amide derivative of a poly(ethylenimine) containing about 50%w of fluorine, 5%w of sulfur, and 1.8%w of nitrogen. Polymer C is a poly(1H,1H,2H,2H-petadecafluorononyl methacrylate). Polymer D is a copolymer of perfluorooctanesulfonamidoethyl methacrylate and lauryl methacrylate. Polymer E is a poly(perfluorooctanesulfonamidoethyl acrylate).

Next, the equilibrium contact angel $\theta$ of a sessile drop to toluene on the horizontal surface of the above polymers coated on a piece of aluminum was measured at 22° C to delineate the relative wettability of the polymeric surface by aromatics. In Table 2 below are given these data.

Table 2

| Polymer | Contact Angle, $\theta$, for Toluene at 22° C. |
|---|---|
| A | 66° |
| B | 48° |
| C | 64° |
| D | 71° |
| E | 59° |

None of the above fluoropolymer coatings was wettable by any hydrocarbon gasoline component, either aliphatic or aromatic.

A dilute (<2% by wt.) solution of each of polymers A through E in an appropriate solvent, such as 1,1,2-trichlorotrifluoroethane, acetone, ethyl acetate, and the like, was added to gasoline drop-wise, with stirring, to yield a concentrate of about 50 ppm by weight of polymer in gasoline. Manifold coating tests were conducted with a 1971 383 2-V Plymouth laboratory engine. Wettability of the intake manifold was determined (at 29°–40° C) with drops of n-hexane, n-octane, n-decane, n-dodecane and toluene before and after use of gasoline containing polymer A, B, C, D or E. The engine was usually operated on a one-minute cycle between 700 and 2000 rpm. Intake manifold coatings not wettable by any hydrocarbons were obtained after consumption of 10 gallons of gasoline containing about 10 ppm by weight of any one of polymers A, B, C, D, or E. Tests with 50 gallons of gasoline containing about 1 ppm by weightof Polymer A. prepared by addition of a 2% by wt. solution in 1,3-di(trifluoromethyl)benzene, also gave the desired coating on either a new or old intake manifold in a 1972 Plymouth automobile operated between 20 and 50 mph on an outside chassis dynamometer.

The gasoline used hereinabove was an unleaded gasoline containing about 32% by volume of aromatics, about 1% by volume of olefins and about 67% by volume of saturates and had an initial boiling point of 32° C, a 50% boiling point of 101° C and a final boiling point of 206° C by ASTM distillation Method D-86.

EXAMPLE 2

To illustrate the driveability improvement that results from use of the novel fluoropolymer-containing gasoline of the invention, driveability demerits, due to hesitation, stumble, and backfire, were determined in a number of runs with a 1971 383-CID V-8 Plymouth Fury automobile using one fuel, with repeat tests before and after use of the fluoropolymer additive. Tests were conducted at 4° C in a controlled-climate-chassis dynamometer room using a modified Coordinating Research Council (CRS) Schedule II driveability test procedure (described graphically in the accompanying Figure), which consists mainly of a series of 20–40 mph accelerations. The gasoline used in these was an intermediate quality driveability fuel; it was an unleaded gasoline containing about 40% by volume of aromatics, about 1% by volume of olefins and about 59% by volume of saturates and had an initial boiling point of 32° C, a 50% boiling point of 109° C and a final boiling point of 212° C by ASTM distillation Method D-86.

Before use of gasoline containing a fluorine-containing polymer of the invention, six separate driveability tests using gasoline containing no fluoropolymer under identical cold-start conditions with the Plymouth gave an average of 105 total driveability demerits, with a standard deviation of 12.7 demerits. The car was then operated on an acceleration-decleration cycle varying between 20 and 50 mph with 5 gallons of gasoline containing about 50 ppm of Polymer B. At no time during this coating process or subsequent additive driveability tests was the car adjusted in any way. Driveability demerits were then determined using the test gasoline containing about 5 ppm by weight of Polymer B. Six tests now gave an average of 77 driveability demerits with a standard deviation of 6.0. The use of the fluorine-containing polymer in the gasoline clearly provided a significant reduction in driveability demerits or, in other words, an improvement in driveability.

The magnitude (about 27%) of reduction in driveability demerits that resulted from the use of Polymer B in the gasoline was quite comparable to that (about 30%) observed in this vehicle under the same test conditions by switching between a normal, uncoated intake manifold and a manifold that had been coated by direct application of Polymer A.

EXAMPLE 3

Engine malfunctions associated with driveability problems were investigated in a highly-instrumented laboratory V-8 engine test cell, which included a 1970 350-CID Chevrolet engine, an automatic transmission, and a dynamometer with inertial flywheel. The test procedures for evaluating gasoline performance included a two-hour soak at 50° F, a cold start, and 20 cold-engine, 10-second accelerations from 700 rpm to 1500 rpm. Each acceleration involved opening the throttle to a fixed position which gave a 10-inch (Hg) vacuum during acceleration under fully-warmed-up conditions. The response of the engine to throttle opening (especially with the choke open) varied in proportion to driveability problems of the engine and fuel.

The engine was operated in several tests with a leaded gasoline which contained about 35% by volume of aromatics, about 1% by volume of olefins, about 64% by volume of saturates and 2 grams of lead-gallon as tetraethyl lead and which had an initial boiling point of 17° C, a 50% boiling point of 103° C and a final boiling point of 206° C by ASTM distillation Method D-86. With this gasoline containing no fluoropolymer, the engine in repeated experiments required full choke application to prevent stalls during the first three accelerations, and stumbles (which involve short, sharp reductions in acceleration rate) occurred until the eighth acceleration. The engine was then operated with 10 gallons of this gasoline containing about 20 ppm by weight of Polymer B, which provided a nonwettable coating on the inner surfaces of the intake manifold. Cold-start operation with the same gasoline tested earlier now required choking to prevent stalls only on the first cycle, and the last stumble occurred on the fourth acceleration. Therefore, the use of the fluorine-containing polymer in the gasoline significantly improved the driveability performance of the gasoline tested in the engine.

EXAMPLE 4

Polymes F and G are illustrative of fluorine-containing polymers which otherwise meet the criteria of the prior art but which do not meet the criteria of this invention, and, consequently, are not driveability-enhancing additives for gasoline. Polymer F is a poly(2,2,3-trifluorobutyl methacrylate) and Polymer G is a 2-(ω-hydroxypolyethoxy)ethyl perfluorooctanoate; their properties are listed in Table 3 below.

Table 3

| Polymer | Fluorine Content % by wt, F | Critical Surface Tension, $\gamma_c$ at 25° C[a] dynes/cm | Contact Angle, $\theta$, for Toluene at 22° C[a] |
|---|---|---|---|
| F | 25 | 16 | 20° |
| G | 16 | 15 | 21° |

[a]determined as in Example 1.

a. determined as in Example 1.

Although Polymer F, which meets the fluorine content requirement of this invention, and Polymer G, which does not, each have a critical surface tension less than 17 dynes/cm and have low wettability for alkanes and aliphatics, they have contact angles for toluene below 40° and have relatively high wettability for aromatics. polymers F and G exhibit relatively poor repellancy for aromatics and in gasoline yield little or not driveability benefit.

I claim as my invention:

1. A gasoline composition comprising gasoline and from about 0.5 to about 100 parts by weight of a driveability-enhancing fluorine-containing polymer ester of monocarboxylic acid per million parts of gasoline, wherein said polymer possesses (1) a critical surface tension of less than 17 dynes/centimeter at 25° C, (2) a high contact angle of at least 40° to toluene at 22° C, (3) a minimum solubility in gasoline of at least about 5 parts by weight per million, and (4) a fluorine content in the range of from 20 to about 65% by weight of flourine. centimeter at 25° C, (2) a high contact angle of at least 40° to toluene at 22° C, (3) a minimum solubility in gasoline of at least about 5 parts by weight per million, and (4) a fluorine content in the range of from 20 to about 65% by weight of fluorine.

2. Gasoline composition as defined by claim 1 wherein said polymer is a mixture of polymers, said mixture possessing (1) a critical surface tension of less than 17 dynes/centimeter at 25° C, (2) a high contact angle of at least 40° to toluene at 22° C, (3) a minimum solubility in gasoline of at least about 5 parts by weight per million, and (4) a fluorine content in the range of from 20 to about 65% by weight of fluorine.

3. Gasoline composition as defined by claim 1 wherein said polymer is a fluorine-containing homopolymer possessing (1) a critical surface tension of less than 17 dynes/centimeter at 25° C, (2) a high contact angle of at least 40° to toluene at 22° C, (3) a minimum solubility in gasoline of at least about 5 parts by weight per million, and (4) a fluorine content in the range of from 20 to about 65% by weight of fluorine.

4. Gasoline composition as defined by claim 1 wherein said polymer is a fluorine-containing copolymer possessing (1) a critical surface tension of less than 17 dynes/centimeter at 25° C, a high contact angle of at least 40° to toluene at 22° C, (3) a minimum solubility in gasoline of at least about 5 parts by weight per million, and (4) a fluorine content in the range of from 20 to about 65% by weight of fluorine.

5. Gasoline composition as defined by claim 1 wherein said polymer is present in an amount of from about 5 to about 50 parts by weight per million parts of gasoline.

6. The method of improving the driveability of an automobile which comprises operating its internal combustion engine on the gasoline composition defined by claim 1.

7. An additive concentrate for a gasoline composition which comprises a low-boiling halogenated or oxygenated solvent and fluorine-containing polymer ester of monocarboxylic acid possessing (1) a critical surface tension of less than 17 dynes/centimeter at 25° C, (2) a high contact angle of at least 40° to toluene at 22° C, (3) a minimum solubility in gasoline of at least about 5 parts by weight per million, and (4) a fluorine content in the range of from about 20 to about 65% by weight of fluorine, said polymer being present in an amount of from 0.6 to about 2% by weight based on said solvent.

* * * * *

UNITED STATES PATENT AND TRADEMARK OFFICE

CERTIFICATE OF CORRECTION

PATENT NO. : 4,039,301

DATED : August 2, 1977

INVENTOR(S) : JOHN L. LAITY

It is certified that error appears in the above-identified patent and that said Letters Patent are hereby corrected as shown below:

In claim 1, column 12, lines 14-18, delete "centimeter at 25°C, (2) a high contact angle of at least 40°C to toluene at 22°C, (3) a minimum solubility in gasoline of at least about 5 parts by weight per million, and (4) a fluorine content in the range of from about 20 to about 65% by weight of fluorine."

In column 12, lines 47-50 delete "6. The method of improving the driveability of an automobile which comprises operating its internal combustion engine on the gasoline composition defined by claim 1."

In column 12, line 60, after "solvent" insert -- selected from the class consisting of 1,3-di(trifluoromethyl) benzene, 1,1,1-trichloroethane, 1,1,2-trichloro-trifluoroethane, acetone, ethyl acetate, 2-butanone and methyl isobutyl ketone --.

UNITED STATES PATENT AND TRADEMARK OFFICE

CERTIFICATE OF CORRECTION

PATENT NO. : 4,039,301

DATED : August 2, 1977

INVENTOR(S) : JOHN L. LAITY

It is certified that error appears in the above-identified patent and that said Letters Patent are hereby corrected as shown below:

In column 12, line 60, after "and" insert -- a --.

On the cover sheet, "7 Claims" should read -- 6 Claims --.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*